US005436610A

United States Patent [19]

Ballesty et al.

[11] Patent Number: 5,436,610

[45] Date of Patent: Jul. 25, 1995

[54] SYSTEM AND METHOD FOR TRANSFERRING LOCAL ALARM SERVICE MONITORING ON AN OVERLOAD BASIS

[75] Inventors: Carol D. Ballesty, Irvine; Paul R. Knirk, Tustin, both of Calif.; Barry R. Mumm, Minnetonka, Minn.

[73] Assignee: Honeywell Inc., Minneapolis, Minn.

[21] Appl. No.: 990,233

[22] Filed: Dec. 14, 1992

[51] Int. Cl.[6] ..... G08B 1/00

[52] U.S. Cl. ..... 340/286.02; 340/506; 379/45; 379/67

[58] Field of Search ..... 340/286.02, 506, 522, 340/531; 379/45, 46, 67

[56] References Cited

U.S. PATENT DOCUMENTS 4,839,892 6/1989 Sasaki ..... 379/45 X 4,893,328 1/1990 Peacock ..... 379/67

*Primary Examiner*—Jeffery A. Hofsass

*Attorney, Agent, or Firm*—Michael B. Atlass; Robert B. Leonard

[57] ABSTRACT

An alarm system monitoring method for remote monitoring. A local alarm monitoring station receives alarm indications from alarms being monitored. A load processor at the local alarm monitoring station, which may be a part of a first computer, determines whether the local alarm monitoring station should handle the call by comparing its current load of calls to a predetermined limit. If the limit is not crossed by local handling of the call, the local alarm monitoring station will handle the call, and the load number is modified accordingly. If the local alarm monitoring station cannot handle the new call, the call is transferred to a hub station for processing.

2 Claims, 5 Drawing Sheets

SYSTEM AND METHOD FOR TRANSFERRING LOCAL ALARM SERVICE MONITORING ON AN OVERLOAD BASIS

BACKGROUND OF THE INVENTION

The present application relates to alarm systems in general and more specifically to a system of remotely monitoring alarm systems.

In the past, there have been two primary ways of remotely monitoring alarm systems within a building. FIG. 1 shows one of the prior art systems and methods. Building 105 contains an alarm system 106 which then initiates communication with a local alarm monitoring station 115 via telephone line 110. Alarm system 106 is well known in the art and may be a Honeywell model 6000 alarm system.

Once an alarm indication has been received at the local monitoring station 115, a decoder 120 decodes the alarm indication and provides the information to computer 125. Computer 125 stores information such as the name of the owner of building 105, the address of building 105, and the appropriate fire or police agency to notify of the alarm condition. Thereafter, an operator (not shown) may call police station 135 via telephone 130.

The second primary way of monitoring alarms is shown in FIG. 2. Please note that two separate cities, city A and city B, are shown but that city A and city B are identical in all relevant aspects. In the second scheme, alarm 206*a*, which may be similar or identical to alarm 106, produces an alarm across telephone line 210*a* to local monitoring station 215*a*. However, local monitoring station 215*a* does not contain any information on how to respond to an alarm indication. The local monitoring station merely receives alarm indications from an alarm unit and passes them to a hub station 230 via communication link 225*a*. This system provided the benefit for the owner of building 205*a* in that the telephone call from building 205*a* to alarm monitoring station 215*a* is a local phone call thus not requiring toll charges. Communications link 225*a* may extend between distant cities and may require a long distance phone call.

A shortcoming of these systems is that regardless of the number of calls received at the monitoring station, all calls must be handled by that monitoring station.

SUMMARY OF THE INVENTION

The present invention is a system and method for handling an overload of alarm indications. The system includes both a local station and a hub station which both have computers. The local station computer includes a load processor such that the computer can receive alarm indications and shift relevant information to the hub station computer on an overload basis so that an operator at the hub station may call the appropriate agency upon receipt of an alarm indication. The computer at the hub station will then provide information back to the computer at the local monitoring station on what action was taken so that the local monitoring station computer may update its records.

DETAILED DESCRIPTION OF THE PREFERRED EMBODIMENT

Figure 1:
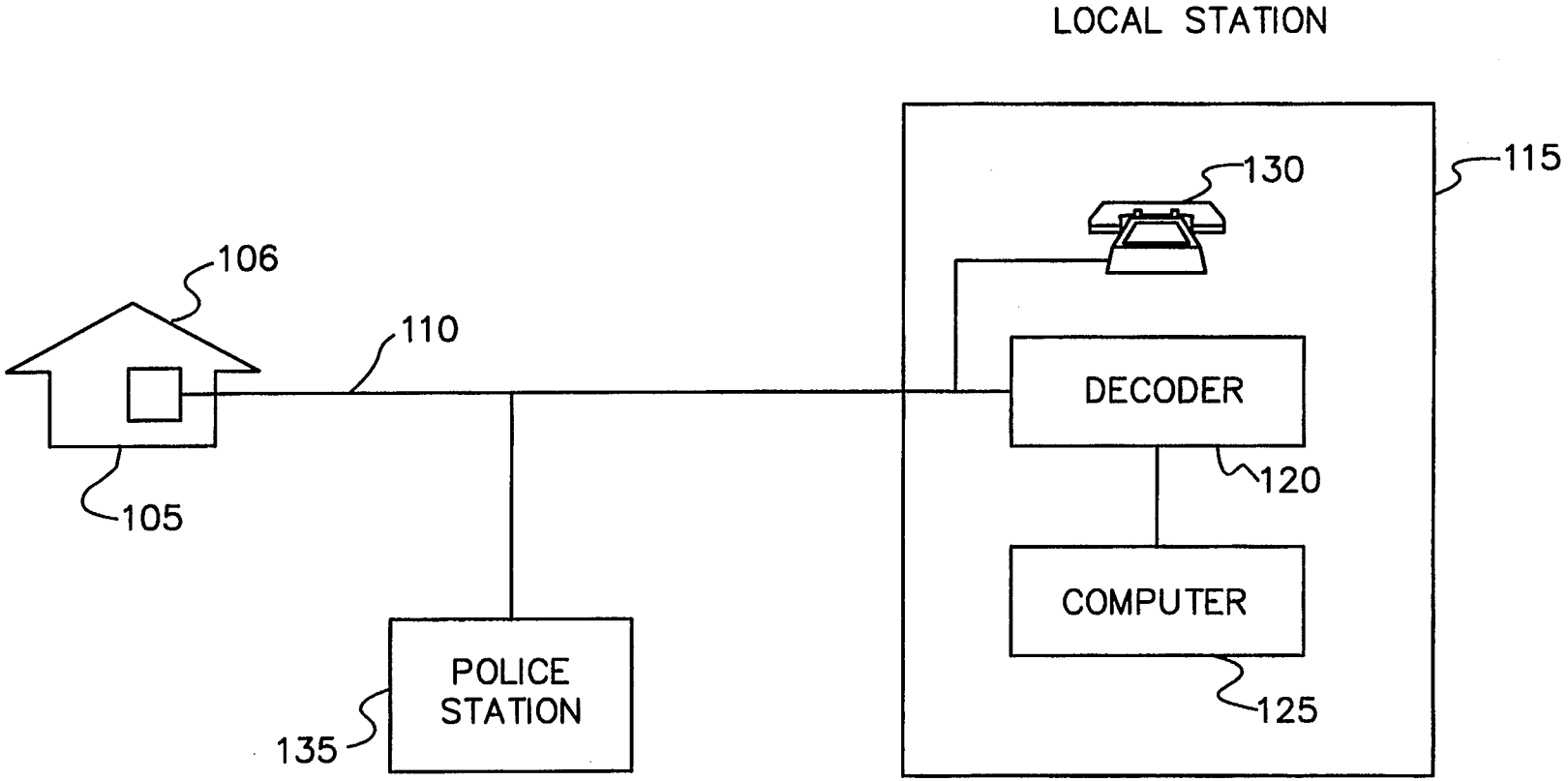
Fig. 1 (Prior Art)
FIG. 1 shows a first prior art system and method of remotely monitoring building alarm systems.
Figure 2:
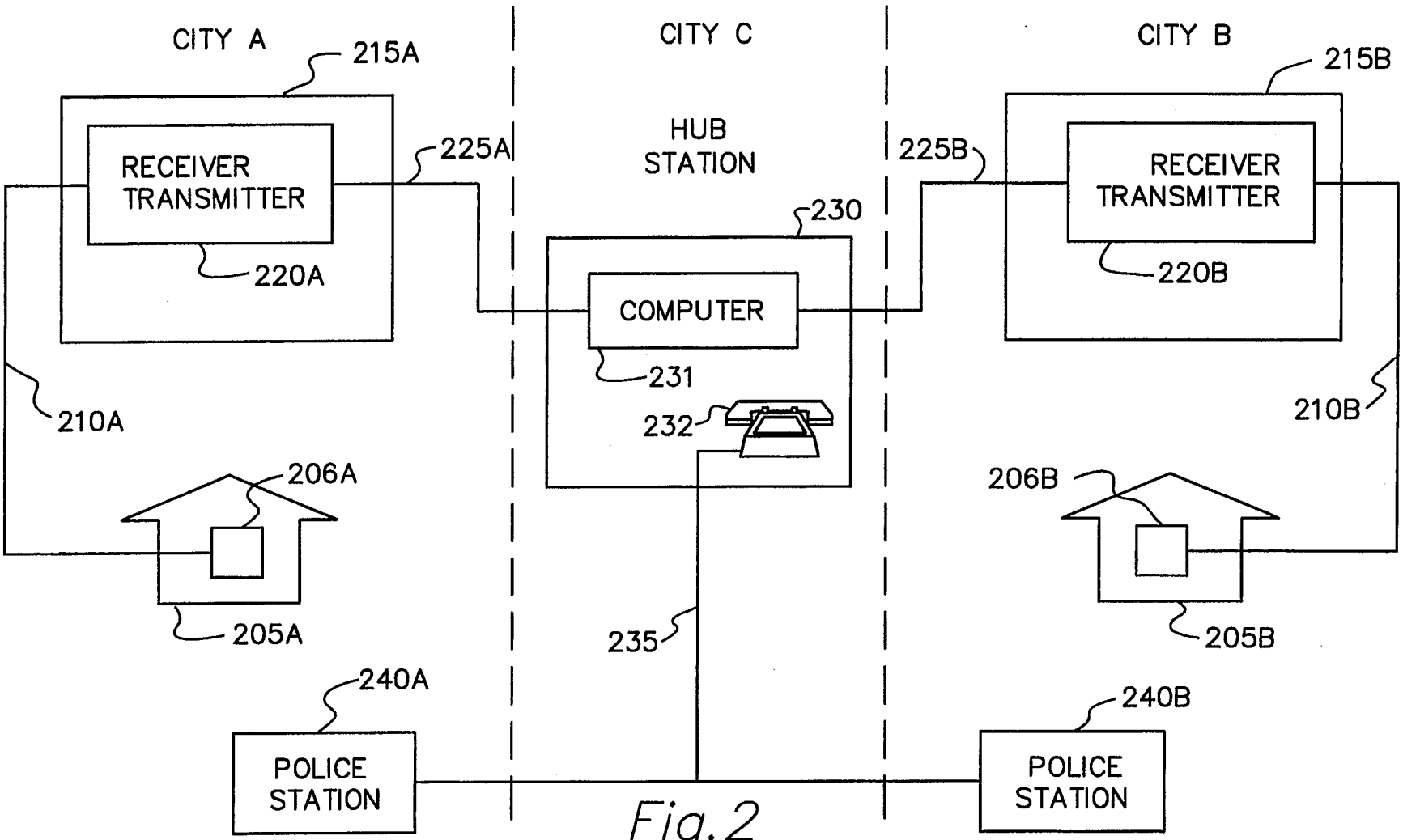
Fig. 2 (Prior Art)
FIG. 2 shows a second system and method for remotely monitoring building alarm systems.
Figure 3:
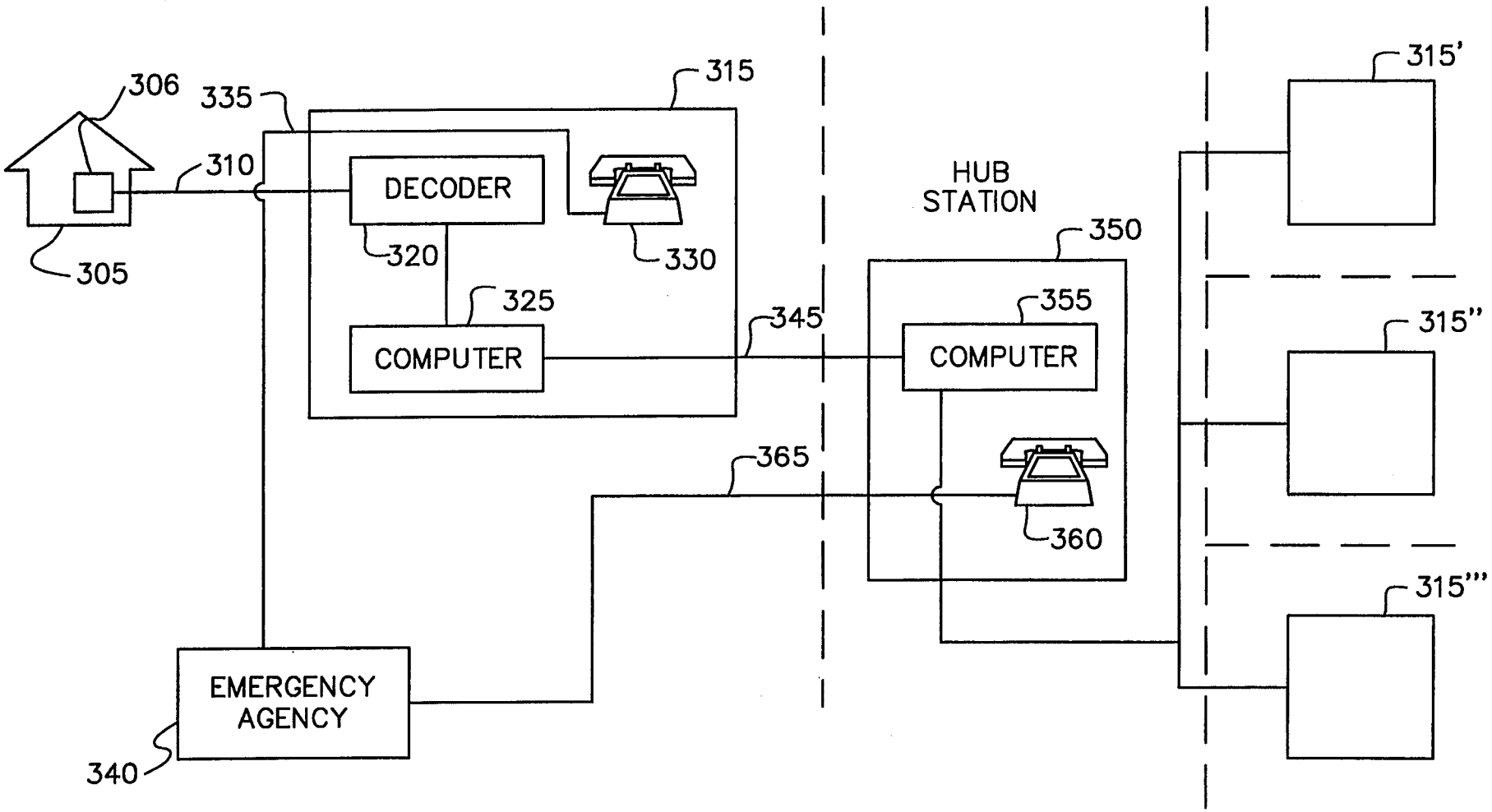
FIG. 3 shows the presently inventive system for remotely monitoring building alarm systems.

Referring now to FIG. 3, there shown is the presently inventive system. When an alarm event occurs in building 305, alarm system 306 generates an alarm signal. The alarm event could be an intrusion, fire, or system malfunction as examples. The alarm signal may indicate the type of alarm event. Then, transmission line 310 transmits the alarm signal (not shown) from building 305 to alarm monitoring station 315. Please note that the transmission line is used as an example only. RF links and other communication systems could be substituted for the transmission line.

At the alarm monitoring station 315, a decoder 320 decodes the alarm signal and passes the decoded signal to computer 325. Computer 325 then searches its record memory (shown in FIG. 4) for a record which matches the information contained in the decoded signal request from the station. A record may contain one or more of the following pieces of information: 1) building owner; 2) address; 3) phone number of building; 4) phone number of appropriate police agency; or 5) phone number of appropriate fire department. Once a matching record is found, the record information is sent via communication link 345, which may be a leased line, to computer 355 at Hub station 350. Hub station 350 may be connected to many alarm system stations 315, 315', 315'' and 315'''. Packet switching technology may be used for transfer of the record information from the alarm monitoring station to Hub Station 350. Computer 355 (which is further described in connection with FIG. 5) will then display the record information for an operator (not shown) to contact the appropriate emergency agency 340 via phone 360.

If computer 325 is in "folddown" (not handling all calls) mode it sends the alarm to the hub computer 355 via communication link 345. When an operator at the hub station 350 selects this alarm to be processed, the hub computer sends a request with the alarm identification to the local computer 325 for supporting data to dispatch on the alarm. Computer 325 then searches its record memory (shown in FIG. 4) for a record which matches the information contained in the request from the hub station.

Once the operator has acted on a received alarm signal, the operator may input data into computer 355 which describes the action(s) taken by the operator. Computer 355 will then send the operator information back to computer 325 for modification of the appropriate records in computer 325.

Note that alarm monitoring station 315 may be set up so that it may also contact the emergency agency 340 directly. In this case, computer 325 would be configured to display record information and an operator would be stationed at alarm monitoring station 315 to handle alarm signals as they occurred.

Figure 4:
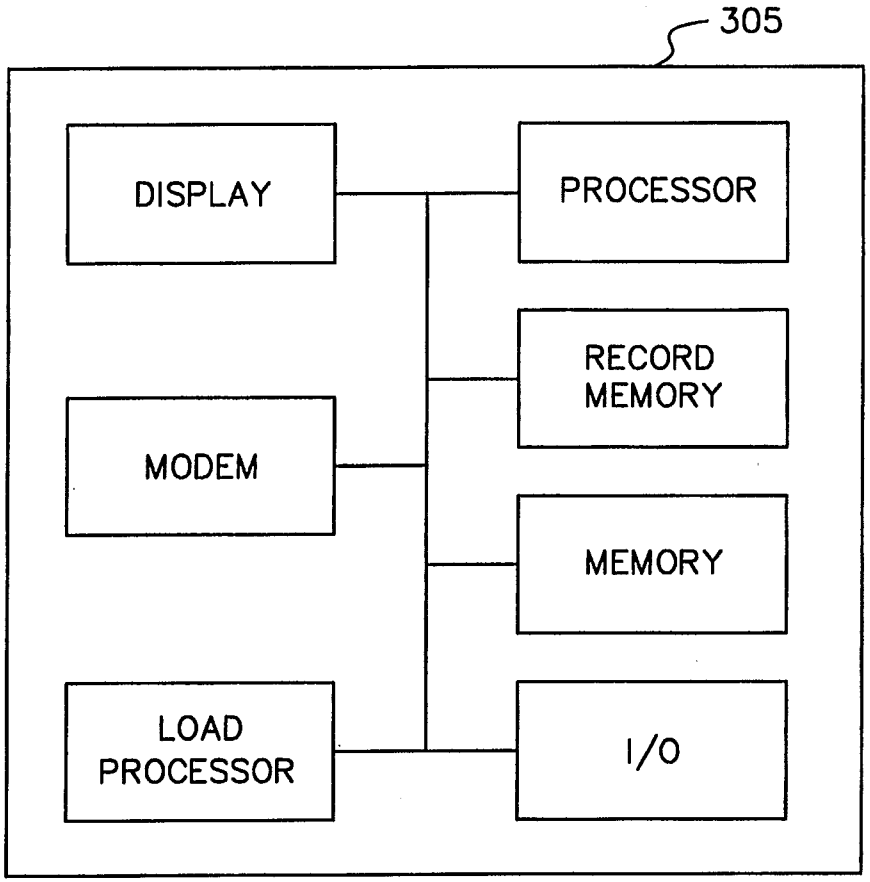
FIG. 4 shows the elements of the computer used at a local monitoring station.

Referring now to FIG. 4, there shown is a block diagram of computer 325. Computer 325 includes a display, a modem, a processor, record memory, memory, load processor and input/output (I/O). The display is used for display of information relevant to records, and alarm system and computer operations. The modem may be used for communications to computer 355. The processor receives instructions from memory (which stores operation information for the processor) and acts on signals received either from the I/O or the modem. Record memory stores record information relevant to alarm systems in buildings monitored by the alarm monitoring station. The I/O is a device for inputting and outputting information to and from the machine. The I/O may include a keyboard and serial and parallel data ports. Decoder 320 may be connected to one of the data ports.

The load processor may be a standalone microprocessor or may be implemented in memory in the base processor unit. The load processor tracks a current number of calls being handled by the local station and compares this number to a preselected limit (AlarmMax). If the current number of calls is in a predetermined relationship to AlarmMax, such as greater than, then alarm calls are transferred from the local station to the Hub station for handling. Note that AlarmMax may be changed to recognize, for example, different staffing levels throughout a day or week. In addition, AlarmMax may at times be set equal to zero so that all calls are transferred to the Hub station.

Figure 5:
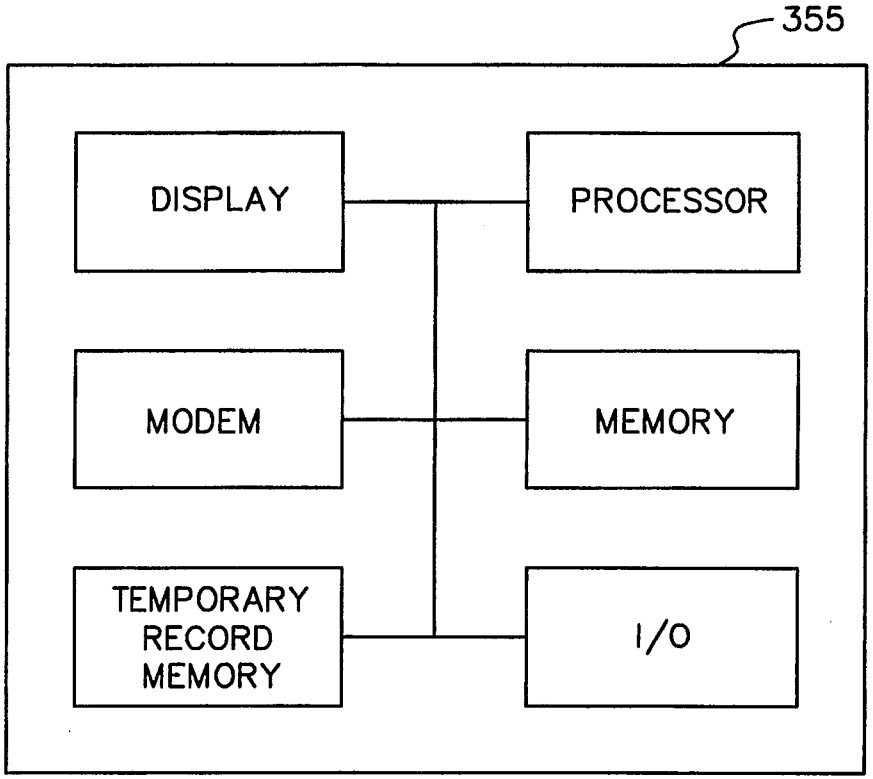
FIG. 5 shows the elements of the computer which resides at a hub station.

The computer 355 shown in FIG. 5 is essentially similar to the computer 325 shown in FIG. 4. The major difference is that computer 355 has temporary record memory and may have record memory for alarm systems in the vicinity of the Hub station instead of having solely record memory. The temporary record memory may be purged of information once the operator has taken action on the record, and the information has been downloaded to computer 325. The computer 355 may also be configured to operate as an alarm monitoring station for the area within which it is situated, and thus would have record memory for alarm systems within its area.

Figure 6:
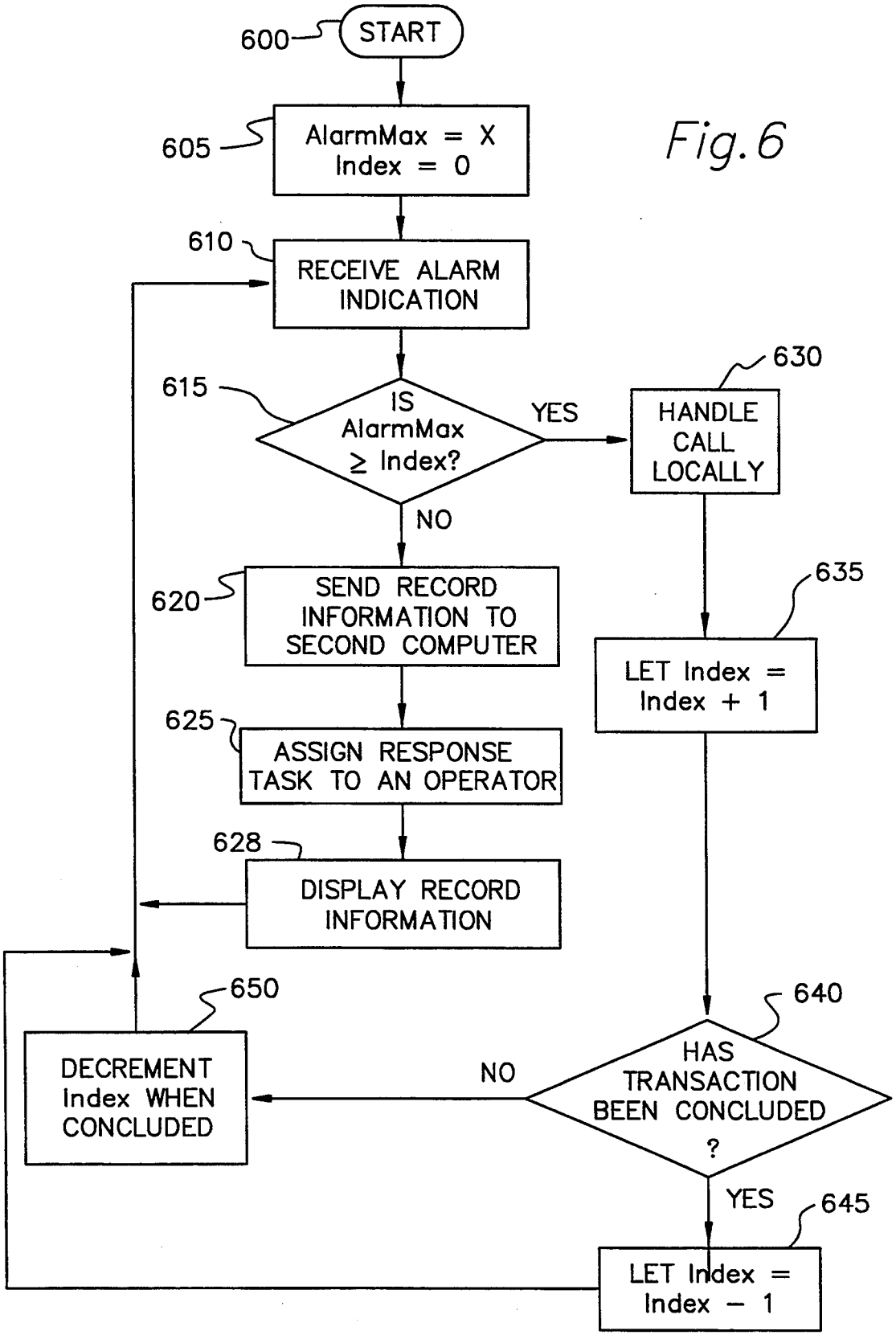
FIG. 6 shows a flow chart of the method used by the presently inventive system.

Referring now to FIG. 6, there shown is the method employed by the inventive system. After starting at block 600, the system sets the variable AlarmMax equal to X and the variable Index equal to zero at block 605. Next, at block 610, the system waits for receipt of an alarm indication. Then at block 615, the system determines whether AlarmMax and Index are in a predetermined relationship, here is AlarmMax less than or equal to Index. Note that other relationships are possible within the spirit of the invention. If the predetermined relationship does not exist, the record information is sent to the second computer as shown by block 620, where the response task is assigned and the record information is displayed according to blocks 625 and 628 respectively.

If the predetermined relationship does exist, the alarm indication is displayed at that alarm monitoring station and handled locally as shown in block 630 and the Index variable is incremented at block 635. The method then determines whether the particular transaction being handled has been terminated at block 640. If not, the method tracks the transaction until completed and decrements Index at that time, while still being able to receive alarm indications. If the transaction is completed at block 640, Index is immediately decremented and the process returns to block 610.

The foregoing has been a description of a system for monitoring building alarm systems. The inventors define the limits of their invention in the claims appended hereto.

We claim:

1. An alarm system monitoring system for monitoring a status of a multiplicity of alarm systems at a plurality of remote sites, comprising:

a local alarm monitoring station located in a site remote from said alarm system having a computer data base having data records corresponding to each alarm system connected to said alarm system for monitoring the status of alarm system;

a hub alarm station located in a site remote from said local alarm monitoring station connected to said local alarm monitoring station;

said local alarm monitoring station including a load processor for comparing a current number of alarms being handled by said local alarm station to a predetermined limit, and transferring alarm calls and the record data associated with each alarm system call to said hub station if said current number of alarms is in a first relationship to said limit.

2. The apparatus of claim 1, wherein:

said load processor increments said current number of calls for each call handled by said local alarm monitoring station and decrements said current number of calls for each call after it is completely processed.

* * * * *